US009924743B2

(12) United States Patent
Liu

(10) Patent No.: US 9,924,743 B2
(45) Date of Patent: Mar. 27, 2018

(54) ELECTRONIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 399 days.

(21) Appl. No.: 14/884,740

(22) Filed: Oct. 15, 2015

(65) Prior Publication Data

US 2017/0013881 A1 Jan. 19, 2017

(30) Foreign Application Priority Data

Jul. 14, 2015 (CN) ..... 2015 1 0412105
Jul. 14, 2015 (CN) ..... 2015 2 0508496 U

(51) Int. Cl.
*H05B 3/12* (2006.01)
*A24F 47/00* (2006.01)

(52) U.S. Cl.
CPC ..... *A24F 47/008* (2013.01); *H05B 3/12* (2013.01); *H05B 2203/021* (2013.01)

(58) Field of Classification Search
CPC ..... H05B 3/02; H05B 3/026; H05B 3/0014; H05B 3/12; H05B 3/40; H05B 3/60; H05B 2203/021; A24F 47/00; A24F 47/008; A24F 23/00; A24F 25/00; A61M 11/00; A61M 11/042; A61M 15/06; H02J 7/0042; H02J 7/0052; H02J 2007/0062
USPC ..... 219/201, 267, 209; 392/395, 404
See application file for complete search history.

(56) References Cited

U.S. PATENT DOCUMENTS 8,857,446 B2 * 10/2014 Wu ..... A24F 47/008 128/202.21
9,345,269 B2 * 5/2016 Liu ..... A24F 47/008
2013/0319407 A1 * 12/2013 Liu ..... A61M 15/06 128/202.21
2015/0245661 A1 * 9/2015 Milin ..... A24F 47/008 131/329

* cited by examiner

*Primary Examiner* — Brian Jennison
(74) *Attorney, Agent, or Firm* — Matthias Scholl, PC; Matthias Scholl

(57) ABSTRACT

An electronic cigarette, including: a cigarette holder converter assembly, an atomization core assembly, a base assembly, and an e-liquid storage assembly. The cigarette holder converter assembly includes: a cigarette holder part and a converter part. The cigarette holder part includes: an inner casing, a cigarette holder, and a first sealing ring for sealing the cigarette holder. The converter part includes: a cigarette holder converter, an upper sealing ring, an inner sealing ring, and an outer sealing ring. The e-liquid storage assembly includes a first regulating ring including a neck. The cigarette holder part and the converter part are connected through interference fit. The cigarette holder converter assembly and the e-liquid storage assembly are connected through interference fit.

6 Claims, 5 Drawing Sheets

ELECTRONIC CIGARETTE

CROSS-REFERENCE TO RELATED APPLICATIONS

Pursuant to 35 U.S.C. § 119 and the Paris Convention Treaty, this application claims the benefit of Chinese Patent Application No. 201510412105.2 filed Jul. 14, 2015, and Chinese Patent Application No. 201520508496.3 filed Jul. 14, 2015, the contents of which are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to an electronic cigarette.

Description of the Related Art

Typically, the heating wire of an electronic cigarette is disposed vertically to the direction of gas flow, and e-liquid is loaded from the bottom part of the electronic cigarette. As a result, it is difficult for the e-liquid to fully contact the heating wire, the combustion of the e-liquid is incomplete at times and at other times the e-liquid is over burned, the produced smoke volume is relatively small, and the flow of smoke is slow, all of which adversely affects the taste of the smoke.

SUMMARY OF THE INVENTION

In view of the above-described problems, it is one objective of the invention to provide an electronic cigarette that comprises a detachable atomization core assembly and a vertically disposed heating wire. The improved electronic cigarette is adapted to produce large smoke volume without the production of scorched smell.

To achieve the above objective, in accordance with one embodiment of the invention, there is provided an electronic cigarette, comprising: a cigarette holder converter assembly, an atomization core assembly, a base assembly, an e-liquid storage assembly. The cigarette holder converter assembly comprises: a cigarette holder part and a converter part. The cigarette holder part comprises: an inner casing, a cigarette holder, and a first sealing ring for sealing the cigarette holder. The converter part comprises: a cigarette holder converter, an upper sealing ring, an inner sealing ring, and an outer sealing ring. The e-liquid storage assembly comprises a first regulating ring comprising a neck. The inner casing, the cigarette holder, and the first sealing ring are integratedly assembled to form the cigarette holder part. The cigarette holder converter, the upper sealing ring, the inner sealing ring, and the outer sealing ring are integratedly assembled to form the converter part. The cigarette holder part and the converter part are connected through interference fit. The cigarette holder converter assembly and the e-liquid storage assembly are connected through interference fit. The cigarette holder converter assembly is locked by the neck when the cigarette holder converter assembly is inserted into the e-liquid storage assembly to a target position. A resistance is produced when the cigarette holder converter assembly is pulled out. When the cigarette holder converter assembly is inserted into the e-liquid storage assembly to a target position, the cigarette holder converter assembly is adapted to rotate to regulate a gas flow via a top part of the cigarette holder.

In a class of this embodiment, the atomization core assembly comprises: a steel mesh, a limit cover, a heating wire, a first organic cotton, a second organic cotton, a second sealing ring, a first fixing ring for fixing the heating wire, a first insulation ring for insulating the heating wire, and a heating wire joint. The steel mesh, the limit cover, the heating wire, the first organic cotton, the second organic cotton, the second sealing ring, the first fixing ring, the first insulation ring, and the heating wire joint are compactly assembled. A position of the heating wire is limited by the limit cover. The second sealing ring is disposed on the limit cover. The heating wire is fixed by the first fixing ring and insulated by the insulation ring. The heating wire is made of stainless steel.

In a class of this embodiment, the base assembly comprises: a third sealing ring for sealing the converter part, a second fixing ring for fixing the heating wire, a fourth sealing ring for sealing an outer copper threaded ring, a gas flow sealing ring, a threaded connection ring, a gas flow regulation ring, an outer copper threaded ring, a second insulation ring, and a joint. The gas flow regulation ring is disposed between the threaded connection ring and the outer copper threaded ring by tight fit. The gas flow regulation ring is adapted to rotate to regulate the gas flow via a bottom part of the electronic cigarette.

In a class of this embodiment, the e-liquid storage assembly comprises: the first regulating ring, a spring, a section pin, a fifth sealing ring for sealing the first regulating ring, an e-liquid loading base, a first sealing gasket, a glass tube, a sealing ring clasp, a sixth sealing ring for sealing an atomization rod, an axel sleeve, a window tube, a second sealing gasket, a third fixing ring for fixing the glass tube. The first sealing gasket and the second sealing gasket are adapted to seal two ends of the glass tube. The spring and the section pin are disposed in two holes of the first regulating ring. The first regulating ring is connected to the axle sleeve by tight fit and the e-liquid loading base is disposed therebetween. The e-liquid loading base is connected to the window tube by tight fit. When the first regulating ring is rotated in a circumference direction for every 90°, a different gear is reached whereby switching the electronic cigarette between an e-liquid loading state and a smoking state.

Advantages of the electronic cigarette according to embodiments of the invention are summarized as below. The e-liquid material can be loaded from the top part of the electronic cigarette and the gas flow can be adjusted by controlling the top part of the electronic cigarette. Additionally, the gas flow can also be adjusted by controlling the bottom part of the electronic cigarette. So, it is convenient for the adjustment of the gas flow.

BRIEF DESCRIPTION OF THE DRAWINGS

The invention is described hereinbelow with reference to the accompanying drawings, in which:

FIG. 4A is an exploded view of a cigarette holder converter assembly, FIG. 4B is an exploded view of an atomization core assembly, FIG. 4C is an exploded view of a base assembly, and FIG. 4D is an exploded view of an e-liquid storage assembly.

DETAILED DESCRIPTION OF THE EMBODIMENTS

For further illustrating the invention, experiments detailing an electronic cigarette are described below. It should be noted that the following examples are intended to describe and not to limit the invention.

Figure 1:
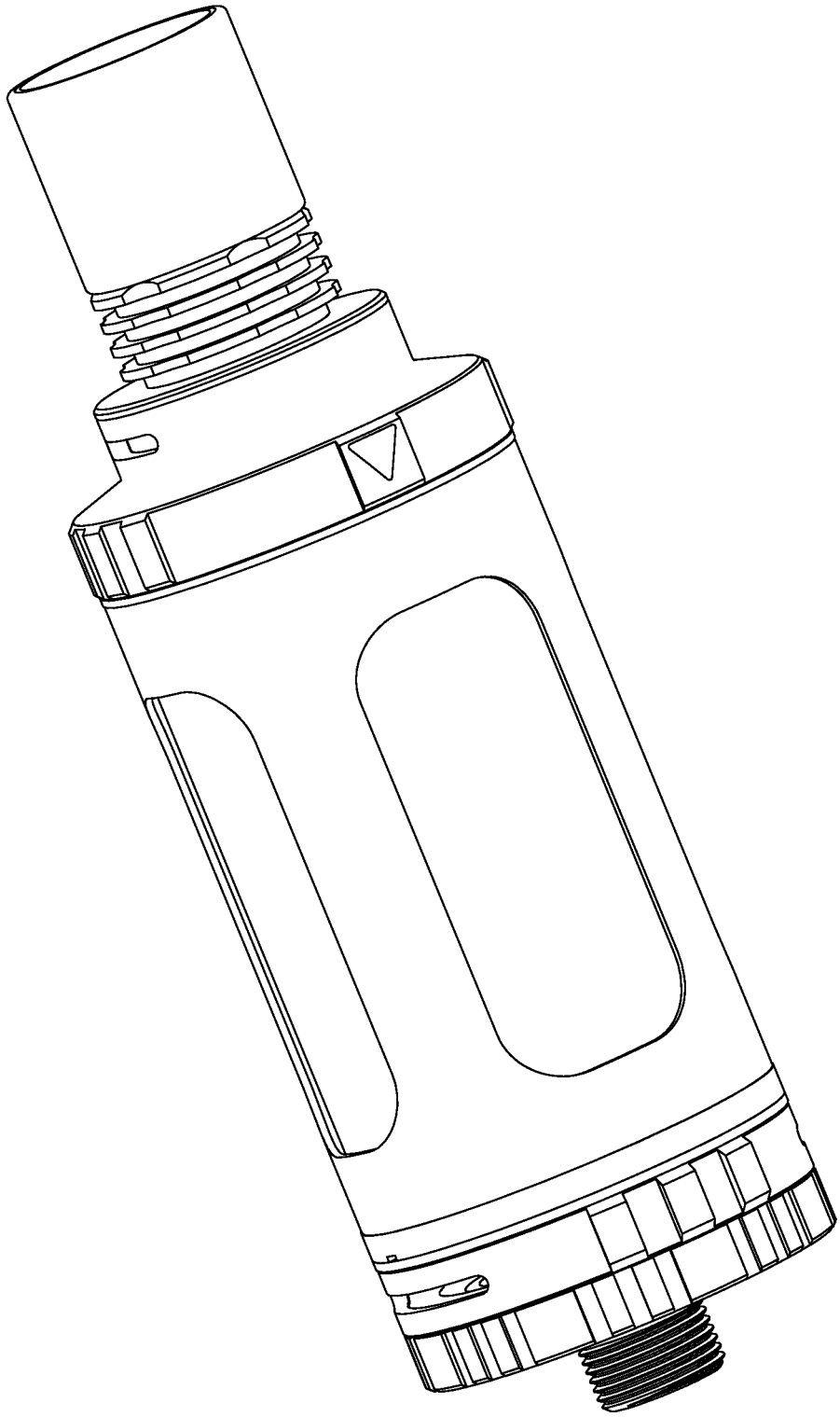
FIG. 1 is a stereogram of an electronic cigarette in accordance with one embodiment of the invention.
Figure 2:
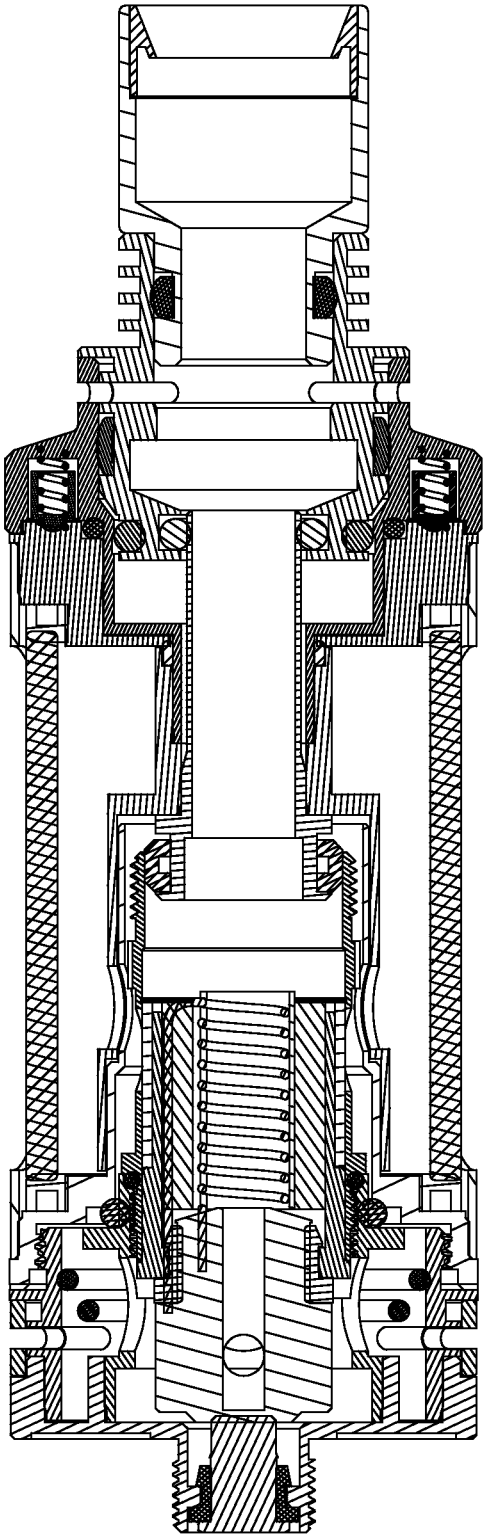
FIG. 2 is a section view of an electronic cigarette in accordance with one embodiment of the invention.
Figure 3:
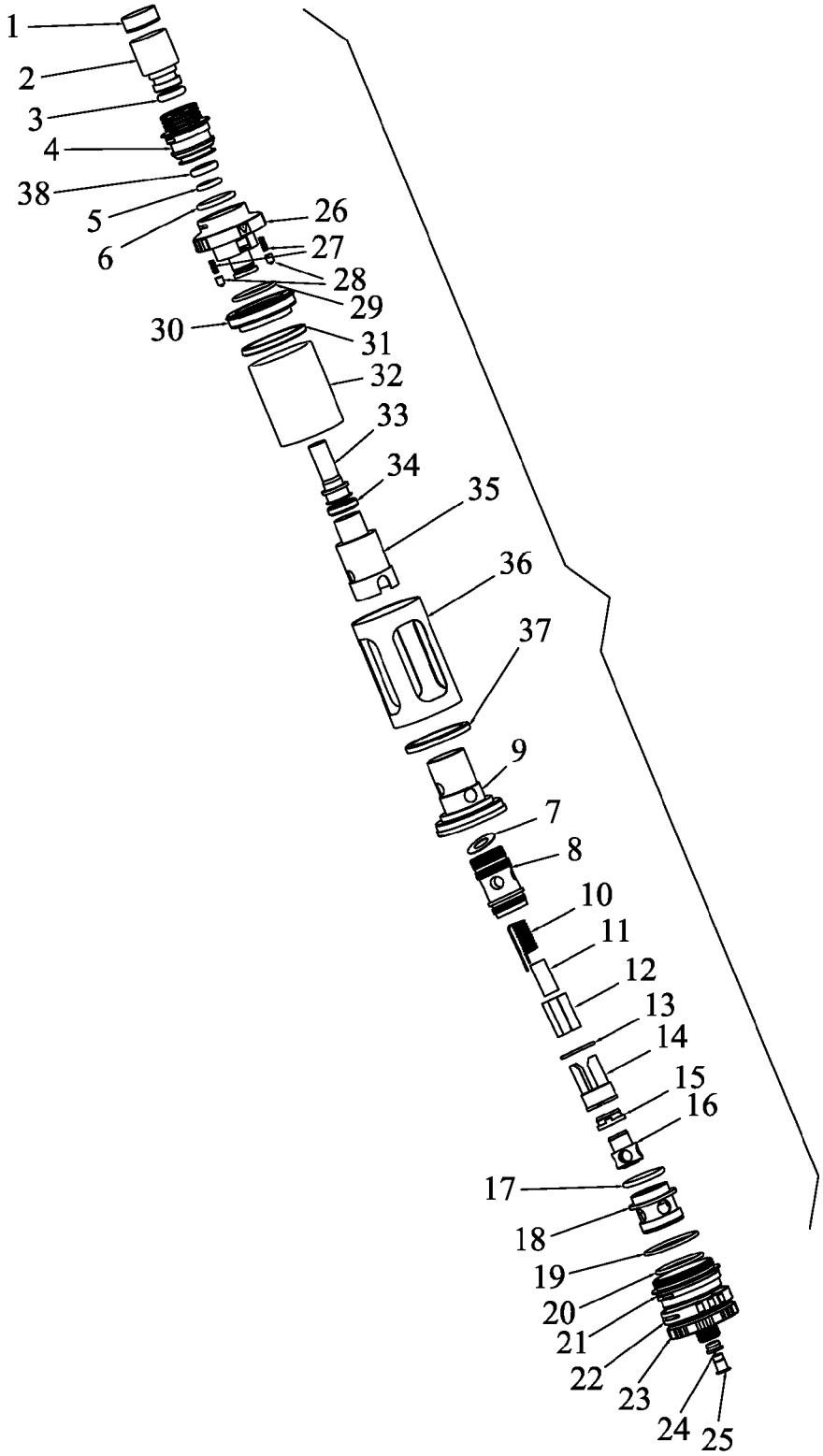
FIG. 3 is an exploded view of an electronic cigarette in accordance with one embodiment of the invention.
Figure 4A:
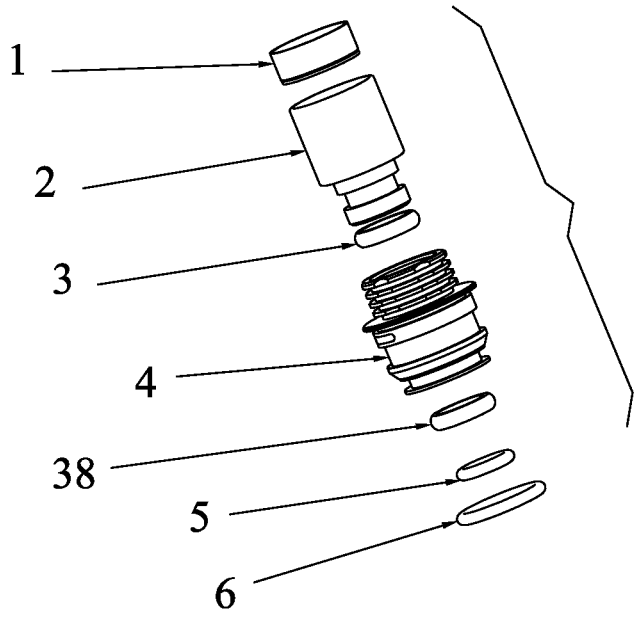
FIGS. 4A-4D are exploded views of an electronic cigarette in accordance with one embodiment of the invention, where
Figure 4B:
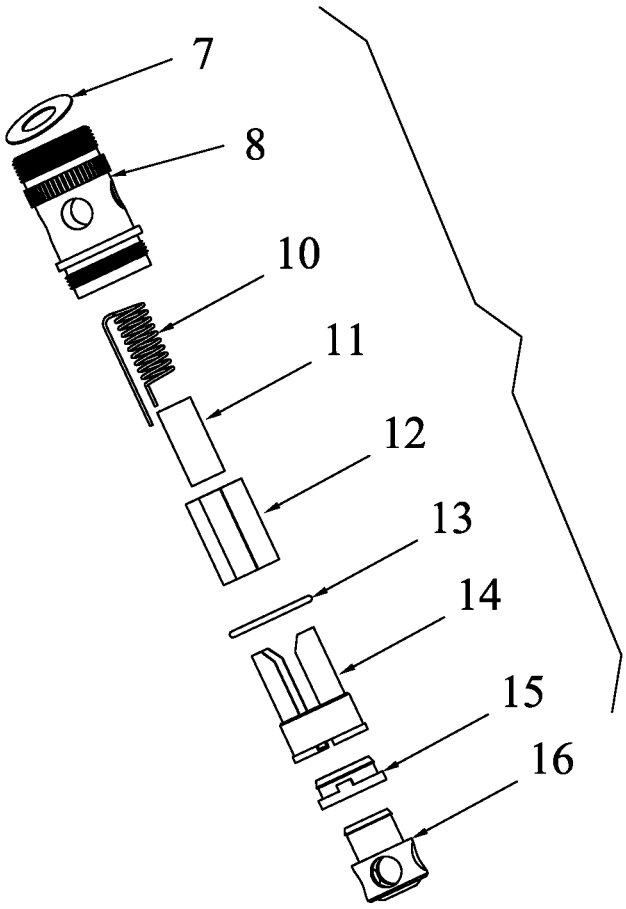
Figure 4C:
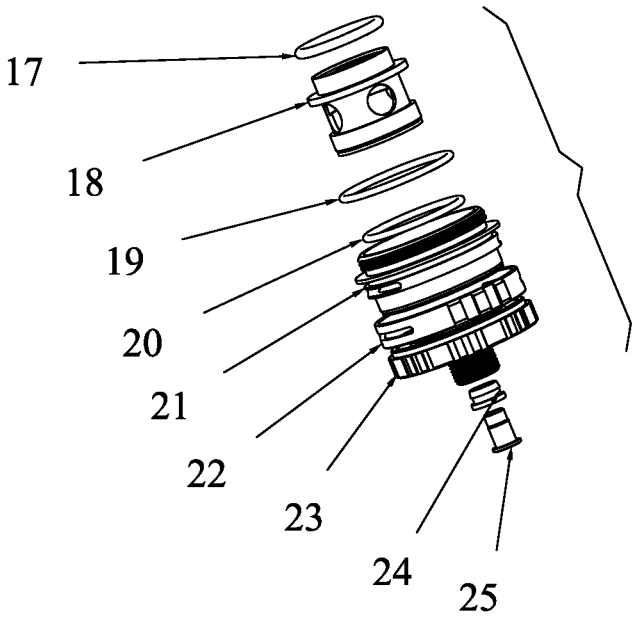
Figure 4D:
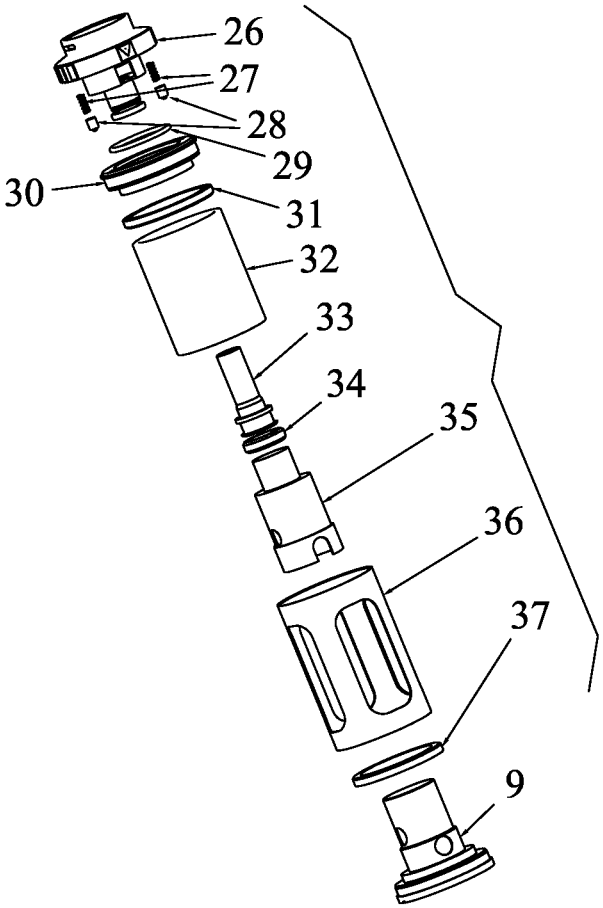

As shown in FIGS. 1-3 and FIGS. 4A-4D an electronic cigarette comprises: a cigarette holder converter assembly A, an atomization core assembly B, a base assembly C, an e-liquid storage assembly D. The cigarette holder converter assembly A comprises: a cigarette holder part and a converter part. The cigarette holder part comprises: an inner casing 1, a cigarette holder 2, and a first sealing ring 3 for sealing the cigarette holder. The converter part comprises: a cigarette holder converter 4, an upper sealing ring 38, an inner sealing ring 5, and an outer sealing ring 6. The e-liquid storage assembly D comprises a first regulating ring comprising a neck. The inner casing 1, the cigarette holder 2, and the first sealing ring 3 are integratedly assembled to form the cigarette holder part. The cigarette holder converter 4, the upper sealing ring 38, the inner sealing ring 5, and the outer sealing ring 6 are integratedly assembled to form the converter part. The cigarette holder part and the converter part are connected through interference fit. The cigarette holder converter assembly A and the e-liquid storage assembly D are connected through interference fit. The cigarette holder converter assembly A is locked by the neck when the cigarette holder converter assembly A is inserted into the e-liquid storage assembly D to a target position. A resistance is produced when the cigarette holder converter assembly A is pulled out. When the cigarette holder converter assembly A is inserted into the e-liquid storage assembly D to a target position, the cigarette holder converter assembly A is adapted to rotate to regulate a gas flow via a top part of the cigarette holder.

Preferably, the atomization core assembly B comprises: a steel mesh 7, a limit cover 8, a heating wire 10, a first organic cotton 11, a second organic cotton 12, a second sealing ring 13, a first fixing ring 14 for fixing the heating wire, a first insulation ring 15 for insulating the heating wire, and a heating wire joint 16. The steel mesh 7, the limit cover 8, the heating wire 10, the first organic cotton 11, the second organic cotton 12, the second sealing ring 13, the first fixing ring 14, the first insulation ring 15, and the heating wire joint 16 are compactly assembled. A position of the heating wire 10 is limited by the limit cover 8. The second sealing ring 13 is disposed on the limit cover 8. The heating wire 10 is fixed by the first fixing ring 14 and insulated by the insulation ring 15. The heating wire 10 is made of stainless steel.

Preferably, the base assembly C comprises: a third sealing ring 17 for sealing the converter part, a second fixing ring 18 for fixing the heating wire, a fourth sealing ring 19 for sealing an outer copper threaded ring, a gas flow sealing ring 20, a threaded connection ring 21, a gas flow regulation ring 22, an outer copper threaded ring 23, a second insulation ring 24, and a joint 25. The gas flow regulation ring 22 is disposed between the threaded connection ring 21 and the outer copper threaded ring 23 by tight fit. The gas flow regulation ring 22 is adapted to rotate to regulate the gas flow via a bottom part of the electronic cigarette.

Preferably, the e-liquid storage assembly D comprises: the first regulating ring 26, a spring 27, a section pin 28, a fifth sealing ring 29 for sealing the first regulating ring, an e-liquid loading base 30, a first sealing gasket 31, a glass tube 32, a sealing ring clasp 33, a sixth sealing ring 34 for sealing an atomization rod, an axel sleeve 35, a window tube 36, a second sealing gasket 37, a third fixing ring 9 for fixing the glass tube. The first sealing gasket 31 and the second sealing gasket 37 are adapted to seal two ends of the glass tube 32. The spring 27 and the section pin 28 are disposed in two holes of the first regulating ring 26. The first regulating ring 26 is connected to the axle sleeve 35 by tight fit and the e-liquid loading base 30 is disposed therebetween. The e-liquid loading base 30 is connected to the window tube by tight fit. When the first regulating ring 26 is rotated in a circumference direction for every 90°, a different gear is reached whereby switching the electronic cigarette between an e-liquid loading state and a smoking state.

In the electronic cigarette of the above technical solution, the e-liquid can be fed from the top part of the electronic cigarette, and the gas flow regulation is realized at both the top part and the bottom part of the electronic cigarette. The heating wire is a hollow tube made of stainless steel. The organic cotton is adapted to guide the e-liquid and is environmentally friendly, thus possessing a good guiding effect.

In one embodiment of the invention, the electronic cigarette comprises: the cigarette holder converter assembly A, the atomization core assembly B, the base assembly C, the e-liquid storage assembly D. The cigarette holder converter assembly A comprises: the cigarette holder part and the converter part. The cigarette holder part comprises: the inner casing 1, the cigarette holder 2, and the first sealing ring 3 for sealing the cigarette holder. The converter part comprises: the cigarette holder converter 4, the upper sealing ring 38, the inner sealing ring 5, and the outer sealing ring 6. The e-liquid storage assembly D comprises the first regulating ring comprising the neck. The inner casing 1, the cigarette holder 2, and the first sealing ring 3 are assembled as the whole to form the cigarette holder part. The cigarette holder converter 4, the upper sealing ring 38, the inner sealing ring 5, and the outer sealing ring 6 are assembled as the whole to form the converter part. The cigarette holder part and the converter part are connected through interference fit. The atomization core assembly B comprises: the steel mesh 7, the limit cover 8, the heating wire 10, the first organic cotton 11, the second organic cotton 12, the second sealing ring 13, the first fixing ring 14 for fixing the heating wire, the first insulation ring 15 for insulating the heating wire, and the heating wire joint 16. The heating wire 10 is made of stainless steel; and the first organic cotton 11 and the second organic cotton 12 are the environmentally friendly organic cotton. The base assembly C comprises: the third sealing ring 17 for sealing the converter part, the second fixing ring 18 for fixing the heating wire, the fourth sealing ring 19 for sealing the outer copper threaded ring, the gas flow sealing ring 20, the threaded connection ring 21, the gas flow regulation ring 22, the outer copper threaded ring 23, the second insulation ring 24, and the joint 25. The gas flow regulation ring 22 is disposed between the threaded connection ring 21 and the outer copper threaded ring 23 by tight fit. The gas flow regulation ring 22 is adapted to rotate to regulate the gas flow via the bottom part of the cigarette holder. The e-liquid storage assembly D comprises: the first regulating ring 26, the spring 27, the section pin 28, the fifth sealing ring 29 for sealing the first regulating ring, the e-liquid loading base 30, the first sealing gasket 31, the glass tube 32, the sealing ring clasp 33, the sixth sealing ring 34 for sealing the atomization rod, the axel sleeve 35, the window tube 36, the second sealing gasket 37, the third fixing ring 9 for fixing the glass tube. The first sealing gasket 31 and the second sealing gasket 37 are adapted to seal two ends of the glass tube 32. The spring 27 and the section pin 28 are disposed in two holes of the first regulating ring 26. The first regulating ring 26 is connected to the axle sleeve 35 by tight fit and the e-liquid loading base 30 is disposed therebetween. The e-liquid loading base 30 is connected to the window tube by tight fit. When the first regulating ring 26 is rotated in the circumference direction for every 90°, the different gear is reached whereby switching the electronic cigarette between the e-liquid loading state and the smoking state.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

a) a cigarette holder converter assembly, the cigarette holder converter assembly comprising: a cigarette holder part and a converter part; the cigarette holder part comprising: an inner casing, a cigarette holder, and a first sealing ring for sealing the cigarette holder; the converter part comprising: a cigarette holder converter, an upper sealing ring, an inner sealing ring, and an outer sealing ring;

b) an atomization core assembly;

c) a base assembly; and d) an e-liquid storage assembly, the e-liquid storage assembly comprising a first regulating ring comprising a neck;

wherein the inner casing, the cigarette holder, and the first sealing ring are integratedly assembled to form the cigarette holder part;

the cigarette holder converter, the upper sealing ring, the inner sealing ring, and the outer sealing ring are integratedly assembled to form the converter part;

the cigarette holder part and the converter part are connected through interference fit;

the cigarette holder converter assembly and the e-liquid storage assembly are connected through interference fit;

the cigarette holder converter assembly is locked by the neck when the cigarette holder converter assembly is inserted into the e-liquid storage assembly to a target position; and when the cigarette holder converter assembly is inserted into the e-liquid storage assembly and reaches the target position, the cigarette holder converter assembly is adapted to rotate to regulate a gas flow via a top part of the electronic cigarette.

2. The electronic cigarette of claim 1, wherein the atomization core assembly comprises: a steel mesh, a limit cover, a heating wire, a first organic cotton, a second organic cotton, a second sealing ring, a first fixing ring for fixing the heating wire, a first insulation ring for insulating the heating wire, and a heating wire joint;

the steel mesh, the limit cover, the heating wire, the first organic cotton, the second organic cotton, the second sealing ring, the first fixing ring, the first insulation ring, and the heating wire joint are compactly assembled;

a position of the heating wire is limited by the limit cover; the second sealing ring is disposed on the limit cover; the heating wire is fixed by the first fixing ring and insulated by the insulation ring; and the heating wire is made of stainless steel.

3. The electronic cigarette of claim 1, wherein the base assembly comprises: a third sealing ring for sealing the converter part, a second fixing ring for fixing the heating wire, a fourth sealing ring for sealing an outer copper threaded ring, a gas flow sealing ring, a threaded connection ring, a gas flow regulation ring, an outer copper threaded ring, a second insulation ring, and a joint;

the gas flow regulation ring is disposed between the threaded connection ring and the outer copper threaded ring by tight fit; and the gas flow regulation ring is adapted to rotate to regulate the gas flow via a bottom part of the electronic cigarette.

4. The electronic cigarette of claim 2, wherein the base assembly comprises: a third sealing ring for sealing the converter part, a second fixing ring for fixing the heating wire, a fourth sealing ring for sealing an outer copper threaded ring, a gas flow sealing ring, a threaded connection ring, a gas flow regulation ring, an outer copper threaded ring, a second insulation ring, and a joint;

the gas flow regulation ring is disposed between the threaded connection ring and the outer copper threaded ring by tight fit; and the gas flow regulation ring is adapted to rotate to regulate the gas flow via a bottom part of the electronic cigarette.

5. The electronic cigarette of claim 1, wherein the e-liquid storage assembly comprises: the first regulating ring, a spring, a section pin, a fifth sealing ring for sealing the first regulating ring, an e-liquid loading base, a first sealing gasket, a glass tube, a sealing ring clasp, a sixth sealing ring for sealing an atomization rod, an axel sleeve, a window tube, a second sealing gasket, a third fixing ring for fixing the glass tube;

the first sealing gasket and the second sealing gasket are adapted to seal two ends of the glass tube;

the spring and the section pin are disposed in two holes of the first regulating ring; the first regulating ring is connected to the axle sleeve by tight fit and the e-liquid loading base is disposed therebetween; the e-liquid loading base is connected to the window tube by tight fit; and when the first regulating ring is rotated in a circumference direction for every 90 degrees, a different gear is reached whereby switching the electronic cigarette between an e-liquid loading state and a smoking state.

6. The electronic cigarette of claim 2, wherein the e-liquid storage assembly comprises: the first regulating ring, a spring, a section pin, a fifth sealing ring for sealing the first regulating ring, an e-liquid loading base, a first sealing gasket, a glass tube, a sealing ring clasp, a sixth sealing ring for sealing an atomization rod, an axel sleeve, a window tube, a second sealing gasket, a third fixing ring for fixing the glass tube;

the first sealing gasket and the second sealing gasket are adapted to seal two ends of the glass tube;

the spring and the section pin are disposed in two holes of the first regulating ring; the first regulating ring is connected to the axle sleeve by tight fit and the e-liquid loading base is disposed therebetween; the e-liquid loading base is connected to the window tube by tight fit; and when the first regulating ring is rotated in a circumference direction for every 90 degrees, a different gear is reached whereby switching the electronic cigarette between an e-liquid loading state and a smoking state.

* * * * *